US006679077B2

(12) United States Patent
Yokomachi et al.

(10) Patent No.: US 6,679,077 B2
(45) Date of Patent: Jan. 20, 2004

(54) PISTON TYPE VARIABLE DISPLACEMENT FLUID MACHINE

(75) Inventors: Naoya Yokomachi, Kariya (JP); Junya Suzuki, Kariya (JP); Kiyoshi Yagi, Kariya (JP); Masakazu Murase, Kariya (JP); Toshiro Fujii, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/205,092

(22) Filed: Jul. 25, 2002

(65) Prior Publication Data

US 2003/0019227 A1 Jan. 30, 2003

(30) Foreign Application Priority Data

Jul. 26, 2001 (JP) ..... 2001-226362

(51) Int. Cl.[7] ..... F25B 1/00; F04B 1/26
(52) U.S. Cl. ..... 62/228.3; 417/222.2
(58) Field of Search ..... 62/228.3, 228.5; 417/222.2, 222.1, 269, 213; 74/60

(56) References Cited

U.S. PATENT DOCUMENTS 4,867,649 A * 9/1989 Kawashima et al. ..... 417/222 S
5,063,829 A * 11/1991 Takao et al. ..... 92/71
5,934,170 A 8/1999 Morita ..... 92/12.2

FOREIGN PATENT DOCUMENTS

JP 10-153170 6/1998 ..... F04B/27/08

* cited by examiner

*Primary Examiner*—Marc Norman
(74) *Attorney, Agent, or Firm*—Morgan & Finnegan, LLP

(57) ABSTRACT

A piston type variable displacement fluid machine includes a drive shaft and a cylinder bore. A piston reciprocates along a line of movement in the cylinder bore in accordance with the rotation of the drive shaft. The stroke of the piston is varied between the maximum stroke and the minimum stroke, which is greater than zero. The displacement of the fluid machine is changed in accordance with the stroke of the piston. A ring groove is formed on the outer circumferential surface of the piston. A piston ring is fitted in the ring groove and moves with respect to the piston in the line of movement of the piston. An allowable movement amount of the piston ring with respect to the piston is greater than or equal to the minimum stroke of the piston.

11 Claims, 2 Drawing Sheets

PISTON TYPE VARIABLE DISPLACEMENT FLUID MACHINE

BACKGROUND OF THE INVENTION

The present invention relates to a piston type variable displacement fluid machine. More specifically, the present invention pertains to a piston type variable displacement compressor that is used in a vehicular air-conditioner and includes piston rings each sealing the space between one of pistons and the inner circumferential surface of a corresponding cylinder bore.

A typical compressor used in a vehicular air-conditioner includes a clutch mechanism, such as an electromagnetic clutch, on a power transmission path between an external drive source, which is an engine, and the compressor. When refrigeration is not needed, the electromagnetic clutch is turned off to prevent power transmission from the engine to the compressor, thereby deactivating the compressor.

Turning on and off the electromagnetic clutch generates a shock, which lowers the driving performance of a vehicle. Therefore, clutchless type compressors are now widely being used. In a clutchless type compressor, the clutch mechanism is not arranged on the power transmission path between the engine and the compressor.

The clutchless type compressor employs a piston type variable displacement compressor that can vary the displacement by adjusting the stroke of the piston. When refrigeration is not needed, the stroke of the piston is minimized to minimize the displacement of the compressor. This minimizes the power loss of the engine.

The clutchless type compressor is always driven when the engine is running. Therefore, when the minimum displacement of the compressor is set to zero, refrigerant gas containing lubricant does not flow through the refrigeration circuit. Thus, sliding parts inside the compressor are not sufficiently lubricated.

Therefore, the minimum displacement of the compressor, or the minimum stroke of the piston, cannot be set to zero. Thus, the pistons reciprocate even when the compressor is driven at the minimum displacement. This increases the power loss of the engine by the sliding resistance caused between each piston ring and the inner circumferential surface of a corresponding cylinder bore.

In a case when carbon dioxide is used as refrigerant, the refrigerant pressure in the compression chamber is much higher than when chlorofluorocarbon is used. Therefore, to suppress blowby gas, each piston ring needs to be pressed against the inner circumferential surface of the corresponding cylinder bore with much more strength than when chlorofluorocarbon is used. This increases the power loss of the engine.

SUMMARY OF THE INVENTION

Accordingly, it is an objective of the present invention to provide a piston type variable displacement fluid machine that has reduced sliding resistance between each piston and a corresponding cylinder bore during the minimum displacement of the fluid machine.

To achieve the above objective, the present invention provides a piston type variable displacement fluid machine. The fluid machine includes a housing, a drive shaft, a cylinder bore, a piston and a piston ring. The drive shaft is rotatably supported by the housing. The cylinder bore is formed in the housing. The piston is accommodated in the cylinder bore. The cylinder bore has an inner circumferential surface and the piston has an outer circumferential surface. The piston reciprocates along a line of movement in the cylinder bore in accordance with the rotation of the drive shaft. The stroke of the piston is varied between a predetermined maximum stroke and a predetermined minimum stroke, which is greater than zero. The displacement of the fluid machine is changed in accordance with the stroke of the piston. A ring groove is formed on the outer circumferential surface of the piston. The piston ring is fitted in the ring groove. The piston ring moves with respect to the piston in the line of movement of the piston. An allowable movement amount of the piston ring with respect to the piston is greater than the minimum stroke of the piston.

The present invention also provides a piston for a piston type variable displacement fluid machine. The fluid machine includes a cylinder bore, which accommodates the piston. The cylinder bore has an inner circumferential surface. The piston has an outer circumferential surface and reciprocates along a line of movement in the cylinder bore in accordance with the rotation of a drive shaft. The stroke of the piston is varied between a predetermined maximum stroke and a predetermined minimum stroke, which is greater than zero. The displacement of the fluid machine is changed in accordance with the stroke of the piston. The piston includes a ring groove and a piston ring. The ring groove is formed on the outer circumferential surface of the piston. The ring groove faces the inner circumferential surface of the cylinder bore. The piston ring is fitted in the ring groove. The piston ring moves with respect to the piston in the line of movement of the piston. An allowable movement amount of the piston ring with respect to the piston is greater than or equal to the predetermined minimum stroke of the piston.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 2(*b*) is an enlarged partial cross-sectional view illustrating the piston being located at the bottom dead center when the compressor shown in FIG. 1 is running at the minimum displacement.

DETAILED DESCRIPTION OF THE PREFERRED EMBODIMENTS

A fluid machine, which is a piston type variable displacement compressor according to a preferred embodiment of the present invention, will now be described with reference to FIGS. 1, 2(*a*), and 2(*b*). The compressor is used in a vehicular air-conditioner.

Figure 1:
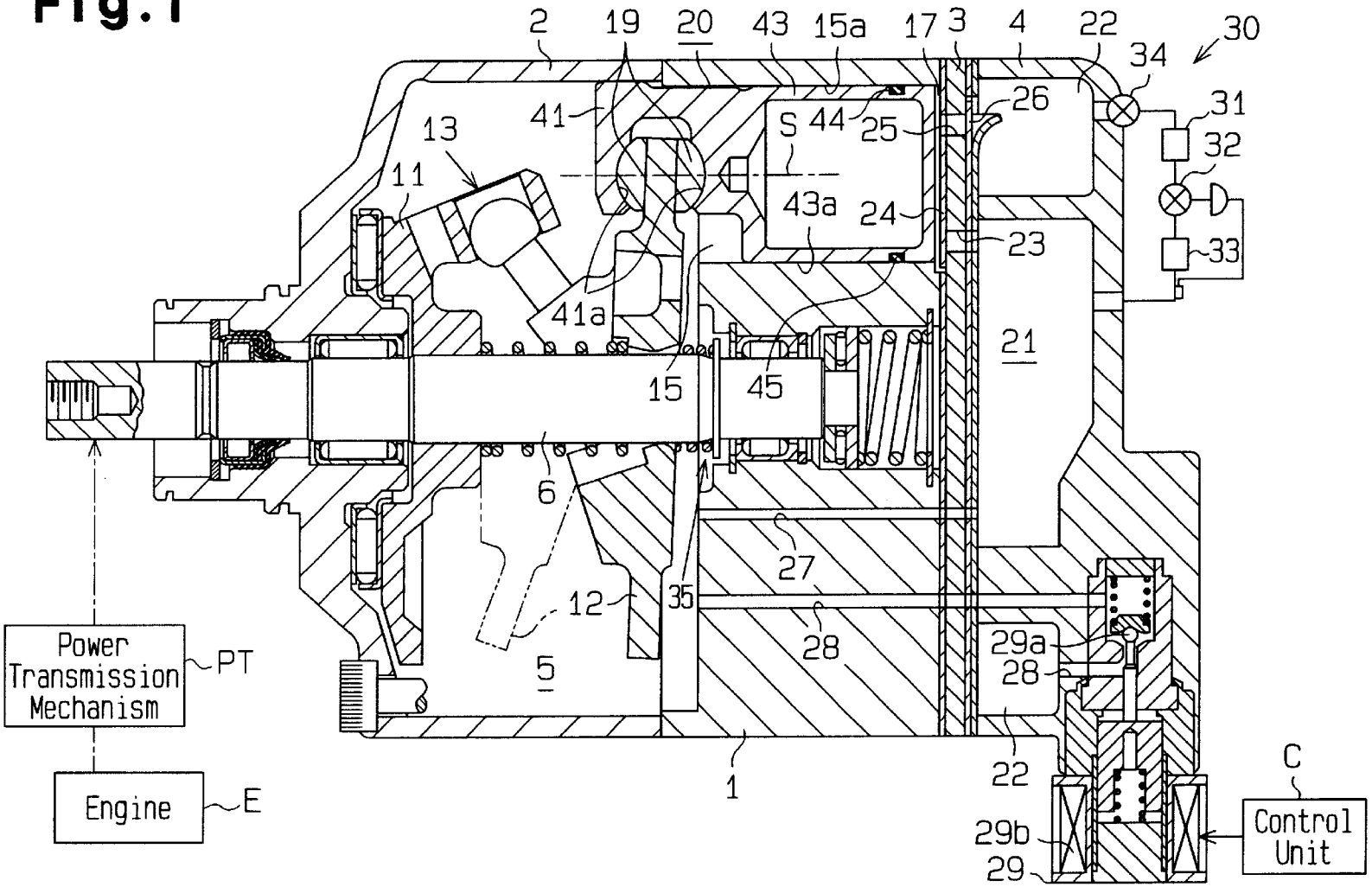
FIG. 1 is a cross-sectional view illustrating a piston type variable displacement compressor according to a preferred embodiment of the present invention.

As shown in FIG. 1, the piston type variable displacement compressor includes a cylinder block 1, a front housing member 2, a valve plate assembly 3, and a rear housing member 4. The front housing member 2 is secured to the front end of the cylinder block 1. The rear housing member 4 is secured to the rear end of the cylinder block 1 with the valve plate assembly 3 in between. In this embodiment, the cylinder block 1, the front housing member 2, and the rear housing member 4 form a housing assembly. The left end of the compressor in FIGS. 1 to 2(*b*) is defined as the front of the compressor, and the right end is defined as the rear of the compressor.

The cylinder block 1 and the front housing member 2 define a crank chamber 5. A drive shaft 6 extends through the crank chamber 5 and is rotatably supported by the cylinder block 1 and the front housing member 2. A lug plate 11 is coupled to the drive shaft 6 and is located in the crank chamber 5. The lug plate 11 rotates integrally with the drive shaft 6.

The front end of the drive shaft 6 is connected to and is driven by a drive source, which is an engine (internal combustion engine) E in this embodiment, through a power transmission mechanism PT. In this embodiment, the power transmission mechanism PT is a clutchless mechanism that includes, for example, a belt and a pulley. The power transmission mechanism PT therefore constantly transmits power from the engine E to the compressor when the engine E is running. Alternatively, the mechanism PT may be a clutch mechanism (for example, an electromagnetic clutch) that selectively transmits power when supplied with a current.

A drive plate, which is a swash plate 12 in this embodiment, is located in the crank chamber 5. The swash plate 12 slides along and inclines with respect to the drive shaft 6. A hinge mechanism 13 is arranged between the lug plate 11 and the swash plate 12. The hinge mechanism 13 and the lug plate 11 cause the swash plate 12 to rotate integrally with the drive shaft 6.

Cylinder bores 15 (only one shown) are formed in the cylinder block 1. The cylinder bores 15 are arranged about the axis of the drive shaft 6 at predetermined angular intervals. A single headed piston 20 is accommodated in each cylinder bore 15. The piston 20 reciprocates along a line of movement inside the cylinder bore 15. The openings of each cylinder bore 15 are closed by the valve plate assembly 3 and the corresponding piston 20. A compression chamber 17 is defined inside each cylinder bore 15. The volume of each compression chamber 17 changes as the corresponding piston 20 reciprocates. The front end of each piston 20 is coupled to the peripheral portion of the swash plate 12 by a pair of shoes 19. Therefore, when the swash plate 12 is rotated with the drive shaft 6, the shoes 19 convert the rotation of the swash plate 12 into reciprocation of the pistons 20. The inclination of the swash plate 12 determines the stroke length of the pistons 20.

The valve plate assembly 3 and the rear housing member 4 define a suction chamber 21 and a discharge chamber 22, which surrounds the suction chamber 21. The valve plate assembly 3 has suction ports 23, suction valve flaps 24, discharge ports 25 and discharge valve flaps 26. Each set of the suction port 23, the suction valve flap 24, the discharge port 25 and the discharge valve flap 26 corresponds to one of the cylinder bores 15. The suction chamber 21 is communicated with each cylinder bore 15 via the corresponding suction port 23. The discharge chamber 22 is communicated with each cylinder bore 15 via the corresponding discharge port 25.

When each piston 20 moves from the top dead center to the bottom dead center, refrigerant gas in the suction chamber 21, which is a suction pressure zone, is drawn into the compression chamber 17 of the corresponding cylinder bore 15 via the corresponding suction port 23 and suction valve flap 24. When each piston 20 moves from the bottom dead center to the top dead center, refrigerant gas in the corresponding compression chamber 17 is compressed to a predetermined pressure and is discharged to the discharge chamber 22, which is a discharge pressure zone, via the corresponding discharge port 25 and discharge valve flap 26.

As shown in FIG. 1, a bleed passage 27 and a supply passage 28 are formed in the housing assembly. The bleed passage 27 connects the crank chamber 5 with the suction chamber 21. The supply passage 28 connects the crank chamber 5 with the discharge chamber 22. The supply passage 28 is regulated by an electromagnetic valve, which is a control valve 29 in this embodiment. The control valve 29 includes a valve body 29*a* and an electromagnetic actuator 29*b*. The valve body 29*a* adjusts the opening degree of the supply passage 28. The electromagnetic actuator 29*b* operates the valve body 29*a* in accordance with a command from a control unit C.

The opening of the control valve 29 is adjusted to control the balance of the flow rate of highly pressurized gas supplied to the crank chamber 5 through the supply passage 28 and the flow rate of gas conducted out from the crank chamber 5 through the bleed passage 27. The pressure in the crank chamber 5 is thus adjusted. In accordance with a change in the pressure in the crank chamber 5, the difference between the crank chamber pressure and the pressure in each compression chamber 17 is changed, which alters the inclination angle of the swash plate 12. As a result, the stroke of each piston 20, that is, the discharge displacement, is controlled.

For example, when the pressure in the crank chamber 5 is lowered, the inclination angle of the swash plate 12 is increased. This lengthens the stroke of each piston 20 and the compressor displacement is increased accordingly. The line having one long and two short dashes shown in FIG. 1 represents the maximum inclination angle of the swash plate 12 restricted by the lug plate 11.

On the contrary, when the pressure in the crank chamber 5 is increased, the inclination angle of the swash plate 12 is decreased. This shortens the stroke of each piston 20 and the compressor displacement is decreased accordingly. The continuous line shown in FIG. 1 represents the minimum inclination angle of the swash plate 12. The minimum inclination angle is set to a value other than zero (for example, 1 to 10 degrees). That is, the minimum stroke St (min) of each piston 20 is set to a value other than zero. The minimum inclination angle of the swash plate 12 is determined by a limit ring 35 arranged on the drive shaft 6.

As shown in FIG. 1, a refrigerant circuit (refrigeration cycle) of the vehicular air-conditioner includes the compressor and an external refrigerant circuit 30, which is connected to the compressor. The external refrigerant circuit 30 includes a condenser 31, an expansion valve 32, and an evaporator 33. In this embodiment, carbon dioxide is used as refrigerant.

In the refrigerant circuit, a shutter 34 is arranged in a refrigerant passage between the discharge chamber 22 of the compressor and the condenser 31. The shutter 34 closes the refrigerant passage when the pressure in the discharge chamber 22 is lower than a predetermined value and stops the flow of refrigerant through the external refrigerant circuit 30.

The shutter 34 may be a differential valve, which detects the difference between the pressure at its upstream side and the pressure at its downstream side and functions in accordance with the pressure difference. The shutter 34 may also be an electromagnetic valve, which is controlled by the control unit C in accordance with a value detected by a discharge pressure sensor (not shown). Further, the shutter 34 may be a mechanical valve, which closes the refrigerant passage when the swash plate 12 is at the minimum inclination angle.

When refrigeration is not needed, the control unit C stops supplying electric current to the control valve 29. Therefore, the control valve 29 becomes fully open, which increases the pressure in the crank chamber 5. Accordingly, the displacement of the compressor is minimized. When the displacement of the compressor is minimized, the pressure on the side of the shutter 34 that is exposed to the pressure in the discharge chamber 22 becomes lower than the predetermined value and the shutter 34 closes. This stops the flow of refrigerant via the external refrigerant circuit 30. Thus, even when the compressor continues to compress refrigerant gas, the refrigeration is not performed.

The minimum inclination angle of the swash plate 12, or the minimum stroke St (min) of the pistons 20, is not zero. Therefore, even when the displacement of the compressor is minimized, refrigerant gas is drawn in from the suction chamber 21 to the compression chamber 17. The refrigerant gas is then compressed in the compression chamber 17 and discharged to the discharge chamber 22. Thus, a refrigerant circuit is formed within the compressor. That is, refrigerant flows from the discharge chamber 22 and through the supply passage 28, the crank chamber 5, the bleed passage 27, the suction chamber 21, the compression chamber 17, and back to the discharge chamber 22. Lubricant is circulated in the refrigerant circuit with refrigerant. Therefore, even when refrigerant, which includes lubricant, does not flow from the external refrigerant circuit 30, each sliding part (for example, between the swash plate 12 and the shoes 19) is reliably kept lubricated.

As shown in FIG. 1, each piston 20 includes a skirt 41, which accommodates the pair of shoes 19, and a columnar head 43, which is accommodated in the corresponding cylinder bore 15 and defines the corresponding compression chamber 17. The skirt 41 is connected to the head 43 to be arranged along the axial direction S of the cylinder bore 15, or the reciprocation direction of the piston 20. Each skirt 41 has a pair of shoe supports 41*a*. The hemispherical surface of each shoe 19 slides along one of the shoe supports 41*a*.

Figure 2A:
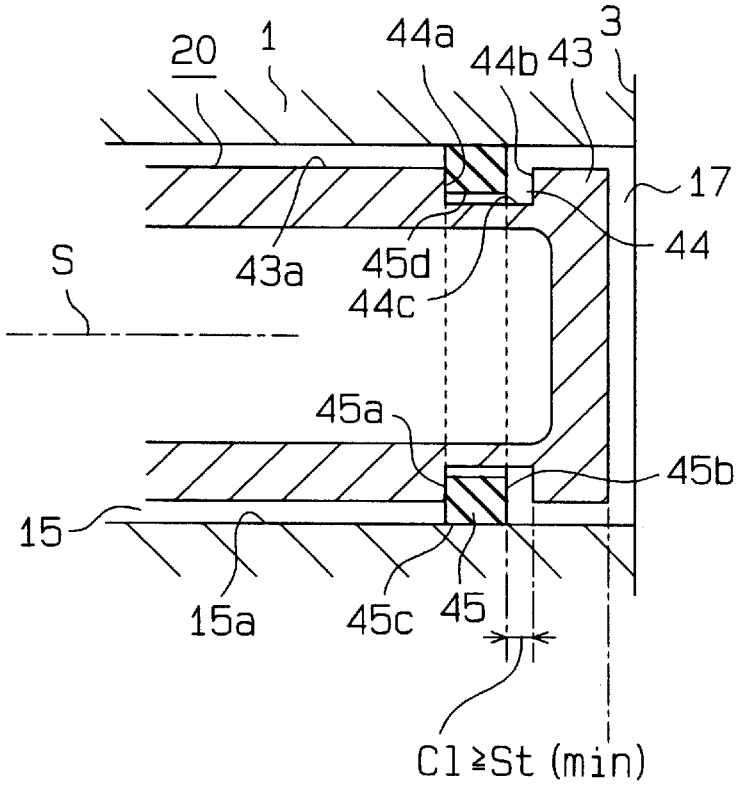
FIG. 2(*a*) is an enlarged partial cross-sectional view illustrating the piston shown in FIG. 1 being located at the top dead center.
Figure 2B:
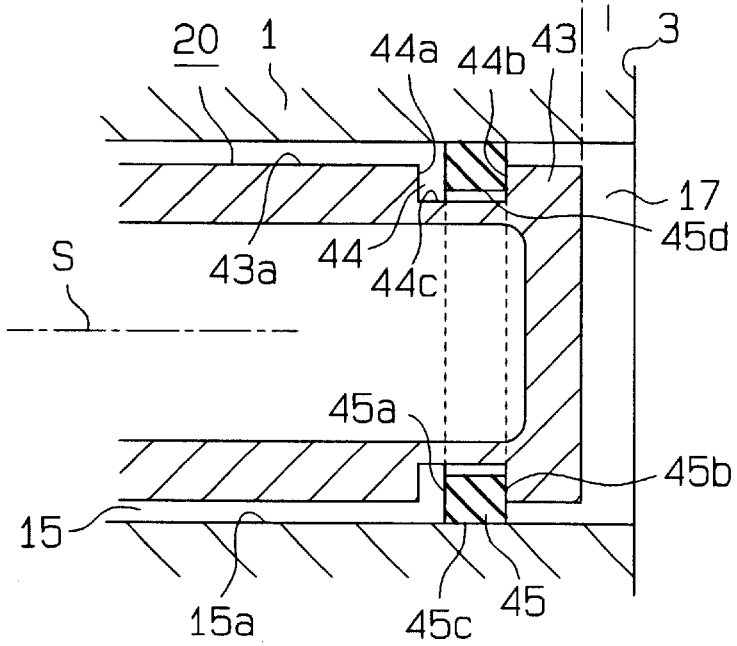

As shown in FIG. 2(*a*), a ring groove 44 having a rectangular cross-section is located at the distal end of each head 43. The ring groove 44 is formed on the outer circumferential surface 43*a* of the head 43 about the axis S. A piston ring 45 having a rectangular cross-section is fitted in each ring groove 44. Each piston ring 45 seals the space between the inner surface 15*a* of the corresponding cylinder bore 15 and the outer circumferential surface 43*a* of the corresponding head 43. Therefore, the crank chamber 5 and the corresponding compression chamber 17 are disconnected.

The outer diameter of each piston ring 45 is greater than the inner diameter of the corresponding cylinder bore 15 in the natural state. Therefore, when each piston ring 45 is inserted in one of the cylinder bores 15 with the corresponding head 43, the peripheral surface 45*c* of the piston ring 45 is pressed against the inner circumferential surface 15*a* of the cylinder bore 15. In this state, a space is formed between the inner bottom surface 44*c* of the ring groove 44 and the inner circumferential surface 45*d* of the piston ring 45 so that a relative movement of the ring groove 44 and the piston ring 45 in the direction of axis S is not hindered.

When each piston 20 moves from the bottom dead center to the top dead center during a compression stroke, the front surface (side facing the crank chamber 5) 45*a* of the corresponding piston ring 45 is pressed against the front inner wall 44*a* of the corresponding ring groove 44 (see FIG. 2(*a*)). When each piston 20 moves from the top dead center to the bottom dead center during a suction stroke, the rear surface (side facing the compression chamber 17) 45*b* of the corresponding piston ring 45 is pressed against the rear inner wall 44*b* of the corresponding ring groove 44 (see FIG. 2(*b*)). The space between each ring groove 44 and the corresponding piston ring 45 is sealed by the front inner wall 44*a* of the ring groove 44 contacting the front surface 45*a* of the piston ring 45 and the rear inner wall 44*b* of the ring groove 44 contacting the rear surface 45*b* of the piston ring 45.

FIG. 2(*a*) illustrates one of the pistons 20 being located at the top dead center. FIG. 2(*b*) illustrates one of the pistons 20 being located at the bottom dead center when the compressor is running at the minimum displacement. As shown in FIGS. 2(*a*) and 2(*b*), a clearance (allowable movement amount) C1 is formed between each ring groove 44 and the corresponding piston ring 45 to permit the ring groove 44 to move relative to the piston ring 45 in the direction of axis S. In FIGS. 2(*a*) and 2(*b*), the clearance C1 is exaggerated for purpose of illustration. The dimension of the clearance C1 is set to a value greater than or equal to the minimum stroke St (min) of the piston 20. In other words, the difference between the width of the ring groove 44 and the width of the piston ring 45 in the line of movement of the piston 20 is greater than or equal to the minimum stroke St (min) of the piston 20. Therefore, when the compressor is running at the minimum displacement, each piston 20 reciprocates without applying force to the corresponding piston ring 45.

The optimal dimension of the clearance C1 is at least equal to 1.2 times the minimum stroke St (min). That is, if the clearance C1 is less than 1.2 times the minimum stroke St (min), each piston 20 might move the corresponding piston ring 45 due to lubricant or foreign objects caught between the ring groove 44 and the piston ring 45. This increases the possibility that the power loss is caused. The clearance C1 should be less than or equal to five times the minimum stroke St (min). That is, if the dimension of the clearance C1 exceeds a value five times the minimum stroke St (min), the play of each piston ring 45 becomes too much and deteriorates the sealing performance of the piston ring 45.

The preferred embodiment provides the following advantages.

(1) When the compressor is running at the minimum displacement, each piston 20 reciprocates without applying force to the corresponding piston ring 45. Since each piston 20 need not move the corresponding piston ring 45, the sliding resistance between the piston 20 and the inner circumferential surface 15*a* of the corresponding cylinder bore 15 is reduced. This reduces the power loss of the engine E and improves the fuel economy of the vehicle.

(2) Carbon dioxide is used as refrigerant gas. Therefore, the pressure in the compression chamber 17 is much higher than when chlorofluorocarbon is used. Therefore, to suppress blowby gas, each piston ring 45 needs to be pressed against the inner circumferential surface 15*a* of the corresponding cylinder bore 15 with much more strength than when chlorofluorocarbon is used. That is, it is particularly effective to apply the present invention to a compressor that uses carbon dioxide as refrigerant to reduce power loss of the engine E while the compressor is running at the minimum displacement.

(3) The clutchless power transmission mechanism PT is used. Therefore, the compressor is always driven when the engine E is running. That is, for example, the compressor is driven even when refrigeration is not needed, or the compressor is always driven through a year. Thus, it is particularly effective to apply the present invention to the compressor for reducing the power loss of the engine E.

It should be apparent to those skilled in the art that the present invention may be embodied in many other specific forms without departing from the spirit or scope of the invention. Particularly, it should be understood that the invention may be embodied in the following forms.

The present invention may be applied to a compressor that has a refrigeration cycle that uses chlorofluorocarbon as refrigerant.

The present invention may be applied to a fluid machine that has double-headed pistons.

The present invention may be applied to a fluid machine other than a refrigerant compressor. The present invention may be applied to, for example, a hydraulic pressure pump for a brake assisting apparatus, a hydraulic pressure pump for a power steering apparatus, or an air pump for an air suspension apparatus.

The drive source of a vehicle may be other than an internal combustion engine. The drive source may be an electric motor.

Therefore, the present examples and embodiments are to be considered as illustrative and not restrictive and the invention is not to be limited to the details given herein, but may be modified within the scope and equivalence of the appended claims.

What is claimed is:

1. A piston type variable displacement fluid machine comprising:

a housing;

a drive shaft, which is rotatably supported by the housing;

a cylinder bore formed in the housing;

a piston accommodated in the cylinder bore, wherein the piston has an outer circumferential surface and reciprocates along a line of movement in the cylinder bore in accordance with the rotation of the drive shaft, and the stroke of the piston is varied between a predetermined maximum stroke and a predetermined minimum stroke, which is greater than zero, wherein the displacement of the fluid machine is changed in accordance with the stroke of the piston, and wherein a ring groove is formed on the outer circumferential surface of the piston; and a piston ring fitted in the ring groove, wherein the piston ring moves with respect to the piston in the line of movement of the piston, and wherein an allowable movement amount of the piston ring with respect to the piston is greater than or equal to the predetermined minimum stroke of the piston.

2. The fluid machine according to claim 1, wherein the fluid machine is a compressor incorporated in a refrigerant circuit of an air-conditioner, and wherein the compressor compresses refrigerant gas in accordance with the movement of the piston.

3. The fluid machine according to claim 2, wherein the refrigerant gas is carbon dioxide.

4. The fluid machine according to claim 1, wherein the fluid machine is mounted in a vehicle, and wherein the drive shaft is driven by a drive source of the vehicle.

5. The fluid machine according to claim 4, wherein the drive source and the drive shaft are coupled to each other by a clutchless power transmission mechanism.

6. The fluid machine according to claim 1, wherein the allowable movement amount of the piston ring is at least 1.2 times the predetermined minimum stroke of the piston.

7. The fluid machine according to claim 1, wherein the allowable movement amount of the piston ring is not more than 5 times the predetermined minimum stroke of the piston.

8. A piston for a piston type variable displacement fluid machine, wherein the fluid machine includes a cylinder bore, which accommodates the piston, wherein the cylinder bore has an inner circumferential surface and wherein the piston has an outer circumferential surface and reciprocates along a line of movement in the cylinder bore in accordance with the rotation of a drive shaft, wherein the stroke of the piston is varied between a predetermined maximum stroke and a predetermined minimum stroke, which is greater than zero, and wherein the displacement of the fluid machine is changed in accordance with the stroke of the piston, the piston comprising:

a ring groove formed on the outer circumferential surface of the piston, wherein the ring groove faces the inner circumferential surface of the cylinder bore; and a piston ring fitted in the ring groove, wherein the piston ring moves with respect to the piston in the line of movement of the piston, and wherein an allowable movement amount of the piston ring with respect to the piston is greater than or equal to the predetermined minimum stroke of the piston.

9. The piston according to claim 8, wherein the allowable movement amount of the piston ring is at least 1.2 times the predetermined minimum stroke of the piston.

10. The piston according to claim 8, wherein the allowable movement amount of the piston ring is not more than 5 times the predetermined minimum stroke of the piston.

11. A piston type variable displacement fluid machine comprising:

a housing;

a drive shaft, which is rotatably supported by the housing;

a cylinder bore formed in the housing;

a piston accommodated in the cylinder bore, wherein the piston has an outer circumferential surface and reciprocates along a line of movement in the cylinder bore in accordance with the rotation of the drive shaft, and the stroke of the piston is varied between a predetermined maximum stroke and a predetermined minimum stroke, which is greater than zero, wherein the displacement of the fluid machine is changed in accordance with the stroke of the piston, and wherein a ring groove is formed on the outer circumferential surface of the piston; and a piston ring fitted in the ring groove, wherein the piston ring moves with respect to the piston in the line of movement of the piston, and wherein the difference between the width of the ring groove and the width of the piston ring in the line of movement of the piston is greater than or equal to the minimum stroke of the piston.

* * * * *